US006152833A

United States Patent [19]

Werner et al.

[11] Patent Number: 6,152,833

[45] Date of Patent: Nov. 28, 2000

[54] LARGE FACE GOLF CLUB CONSTRUCTION

[75] Inventors: Frank D. Werner, Box SR9, Jackson, Wyo. 83001; Richard C. Greig, Jackson, Wyo.

[73] Assignee: Frank D. Werner, Teton Village, Wyo.

[21] Appl. No.: 09/097,421

[22] Filed: Jun. 15, 1998

[51] Int. Cl.[7] ..... A63B 53/04

[52] U.S. Cl. ..... 473/324; 473/345; 473/342; 473/349

[58] Field of Search ..... 473/345, 346, 473/342, 343, 324, 349, 347, 348

[56] References Cited

U.S. PATENT DOCUMENTS

| | | |
|---|---|---|
| Re. 34,925 | 5/1995 | McKeighen . |
| 974,888 | 11/1910 | Jacobus . |
| 1,361,258 | 12/1920 | Horton . |
| 1,485,685 | 3/1924 | McMahon . |
| 1,567,323 | 12/1925 | Jordan . |
| 3,084,940 | 4/1963 | Cissel . |
| 3,455,558 | 7/1969 | Onions . |
| 3,591,183 | 7/1971 | Ford . |
| 3,847,399 | 11/1974 | Raymont . |
| 4,026,561 | 5/1977 | Baldorossi . |
| 4,489,945 | 12/1984 | Kobayashi . |
| 4,496,421 | 1/1985 | Byars . |
| 4,555,115 | 11/1985 | You . |
| 4,568,088 | 2/1986 | Kurahashi . |
| 5,076,585 | 12/1991 | Bouquet . |
| 5,094,457 | 3/1992 | Kinoshita . |
| 5,301,941 | 4/1994 | Allen . |
| 5,310,186 | 5/1994 | Karsten . |
| 5,366,223 | 11/1994 | Werner et al. . |
| 5,380,010 | 1/1995 | Werner et al. . |
| 5,405,136 | 4/1995 | Hardman . |
| 5,417,419 | 5/1995 | Anderson et al. . |
| 5,511,787 | 4/1996 | Baum . |
| 5,570,886 | 11/1996 | Rigal et al. . |
| 5,580,322 | 12/1996 | Bouquet . |

*Primary Examiner*—Sebastiano Passaniti
*Attorney, Agent, or Firm*—Westman, Champlin & Kelly, P.A.

[57] ABSTRACT

A golf club head for a wood club type that has a thick, light weight, low density face wall supported to its rear by a hollow shell structure. The shell structure supports the face wall around the periphery of the face wall, and a club shaft is attached suitably to the rear of the front face of the face wall. The face wall preferably has a club face area greater than 5.3 square inches, and a weight not exceeding half of the total club head weight.

17 Claims, 4 Drawing Sheets

LARGE FACE GOLF CLUB CONSTRUCTION

BACKGROUND OF THE INVENTION

The present invention relates to a golf club that has a face wall which allows the club head to be made larger than other methods of construction without adversely increasing club head weight, while retaining adequate strength and large moments of inertia.

It has been recognized that a larger size of a golf club face is an important advantage to a golfer. With a large face club, it is much easier to avoid hits which are partly off the club face, and a large face allows the club head to be designed to achieve large moments of inertia of the club head, which reduces the errors due to off-center hits.

In the prior art, there have been golf clubs known as "woods" which have been made with solid wood heads, and in some instances these have been faced with plastic, but only when the plastic layer is the front portion of an essentially solid block of wood. At present, most clubs called woods are made as a thin metal shell in two or three parts and a face wall, which are welded together. Aluminum, stainless steel and titanium have been used.

Layers of material that are said to be an advantage have been placed on the front face of a wood club. For example, a layer of titanium cemented into a shallow recess in the face of a stainless steel club head is known. Thin layers of a plastic or rubber-like material have been used on the front surface of putters to form a softer surface, but they supply only a minor part of the strength of the face.

A golf club "wood" is shown in U.S. Pat. No. 5,380,101, which has a hollow head reinforced with a structural element, wherein the face is made of the known materials, including fiberglass reinforced plastic. A golf club shown in U.S. Pat. No. 1,485,685 has a shell type head with wood plugs reinforcing the face in selected locations. Various other types of veneers or synthetic resins also have been used.

U.S. Pat. No. 5,366,223, is also referred to for a showing of orienting a club face for agreement between a hit pattern and a club face perimeter. For a hollow or shell design, a large size allows weight of the club head to be spaced farther from the center of gravity. The moment of inertia about any particular axis of rotation is the summation of each of the mass elements times the square of its distance from the axis of rotation. Thus, the larger size increases the moment of inertia about any axis which may be chosen. This is true even when the wall thickness is somewhat reduced in a hollow head to maintain a given head weight. The large size is beneficial to the golfer because when the ball is hit off center, the club head rotates slightly during impact and disturbs the shot. The magnitude of this disturbance is highly dependent on the moment of inertia about the axis of rotation. Increasing the moment of inertia decreases the errors caused by off-center hits.

One of the criteria for good club design is that the head weight should be kept reasonably near its optimum value. This is about 190 grams for a modern 46 inch shaft. The maximum distance of a drive will be reduced if the head weight is too large or too small. In prior art designs, the face size is limited to a maximum size of 5.21 square inches, which is the largest size found in a survey, sold by Golfsmith International under the trademark "Long Jon". The reason is that this requires the face to be too heavy in order to support the load of impact of ball and club face. This impact load can exceed 3,000 pounds.

SUMMARY OF THE INVENTION

The present invention relates to a large size golf club head of the "wood" design wherein the head is hollow, and has a wall forming a face that is light weight (low density) but strong. The low density face wall is capable of being supported in a large size shell that can be made with a wall thickness sufficient for strength and ease of fabrication, with the weight of the club head being substantially equal to that of club heads which are presently being made. Its large size contributes to good moments of inertia.

Specifically as disclosed, a face wall is constructed of a high strength wood such as maple, and is supported in a hollow shell made of metal or other strong material such as fiberglass, graphite fiber reinforced plastic or laminated wood. The face wall has adequate thickness and therefore, strength, to withstand impact loads when it hits a ball. It can be covered with a layer of suitable material in the ball impact area to suppress abrasion and surface damage to the wood.

To insure adequate strength at a low overall weight for the face wall, the specific embodiment preferred is a laminated maple that is made in laminate sections, which are perpendicular to the long axis of the club face, each typically formed of three plies. Two adjacent plies are oriented so that the wood grain is substantially up and down, and a third ply in each laminate section has the wood grain oriented perpendicular to the ball strike surface. These three ply laminate sections are then all bonded together to form the laminated block from which the face wall is made.

The densities for the face are substantially less than the light weight materials now used for club heads, such as aluminum or titanium, or a composite material such as a graphite reinforced epoxy.

DETAILED DESCRIPTION OF THE PREFERRED EMBODIMENTS

Figure 1:
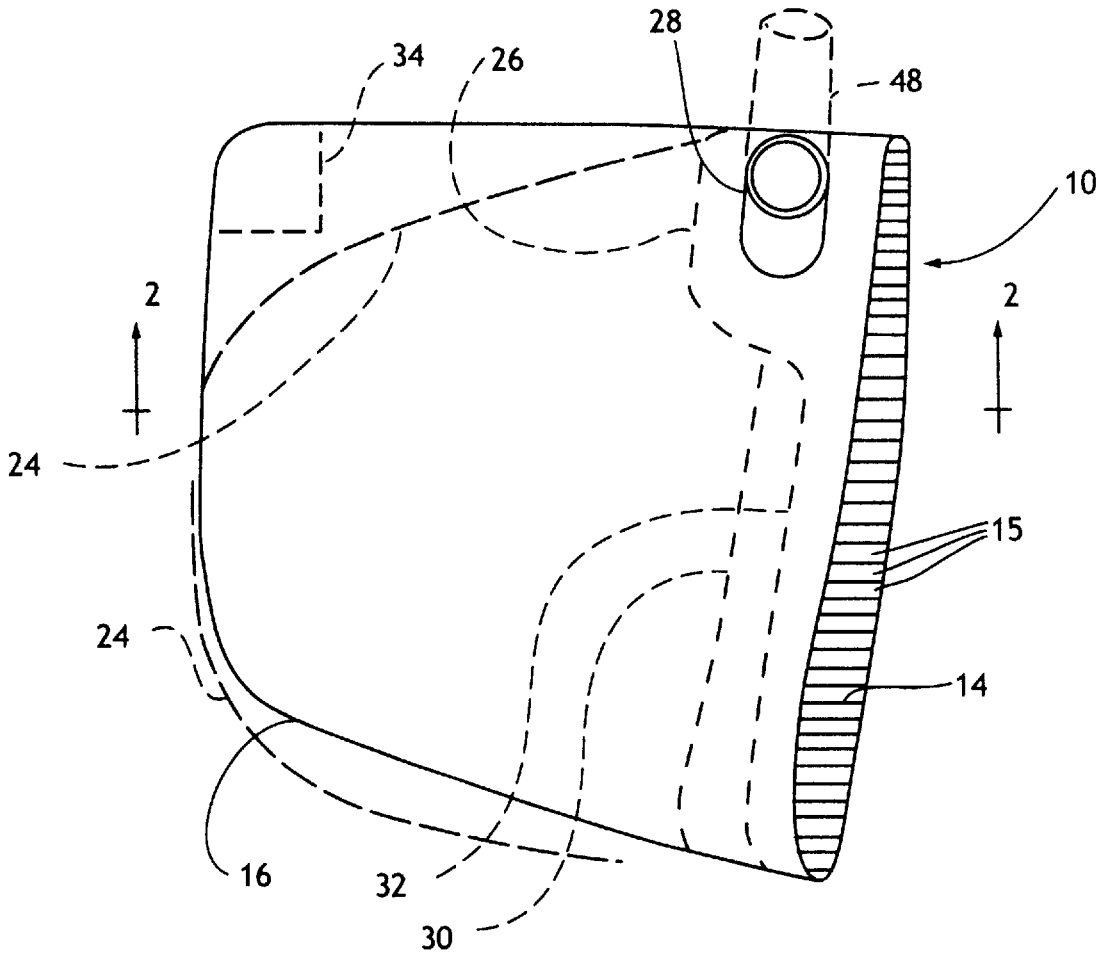
FIG. 1 is approximately a top view of a golf club head made according the present invention.
Figure 2:
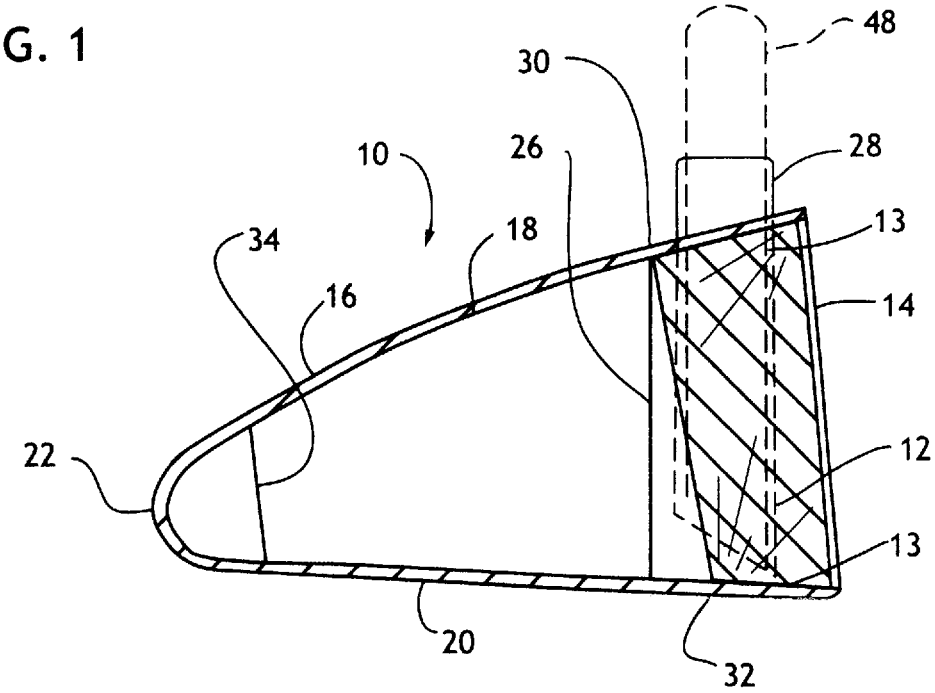
FIG. 2 is a sectional view taken as on line 2—2 in FIG. 1.

A golf club head indicated generally at 10 in FIG. 1, made according to present invention includes a face wall 12 that has a ball striking face surface 14. In FIGS. 1 and 2, the striking face surface 14 is shown without any covering, for sake of illustration. The face wall 12 is supported in a hollow shell indicated at 16, which includes a top wall 18, and a bottom wall 20, and these two walls are joined with a curved rear wall portion 22. The end portions of the walls 18 and 20 adjacent the face wall 12 bound the face wall 12 and are bonded to the edge surface of face wall 12 along interfacing surfaces 13 using a suitable bonding material. The shell 16 can be cast metal in one piece or made in sections and welded together.

FIG. 1 is an approximately downward view of the club head. More accurately, it is a downward view when the club is held so that the long axis of the face is horizontal. The shape of the shell 16 shown in FIG. 1 is generally rectilinear, with a rear wall having an edge generally parallel to face wall 12, but this shape can be made more conventional if desired, as shown by the dotted lines 24 which illustrate a common "wood" golf club head shape when viewed from the top.

The face wall 12 includes a boss forming a hosel attachment section 26 to which a hosel or shaft receiving tube 28 is secured. The dotted lines indicated at 30 and 32 represent the thickness of the face wall 12 at the upper and lower edges of the face wall, respectively.

The shell 16 is made to be structurally sound, and has sufficient thickness of material to support the impact loads on the face wall. The shell may be made of a metal such as stainless steel, strong aluminum or other structural material that can be formed into the shell shape desired. A weight 34 may be mounted inside of the rear portion of the shell adjacent the curved or rounded end wall 22, for appropriately adjusting location of the center of gravity of the club head 10 while at the same time, adding to the moments of inertia.

Figure 3A:
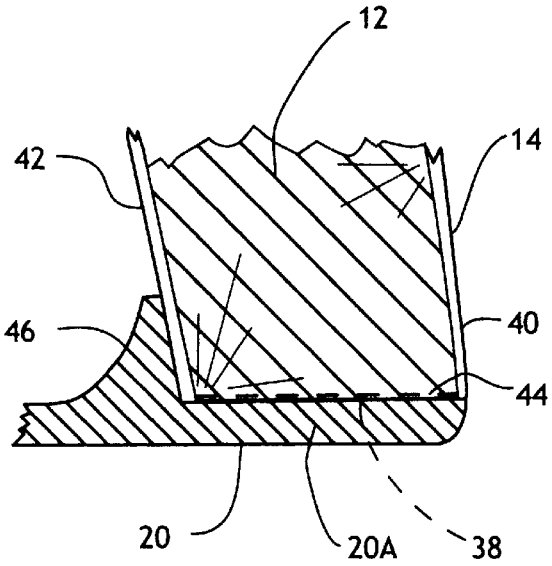
FIGS. 3A and 3B show two enlarged sectional views of a lower part of the face wall shown in FIG. 2 to illustrate details of two versions of the face wall construction.

The face wall 12 is preferably made of wood, typically laminated maple, which is the preferred embodiment. The face wall 12 is substantially thicker from the strike surface 14 to the rear surface than the normal metal face wall presently used. In FIG. 3A, an epoxy or other strong adhesive layer is shown at 38 for making the joint between the face wall 12 and the shell 16.

Figure 3B:
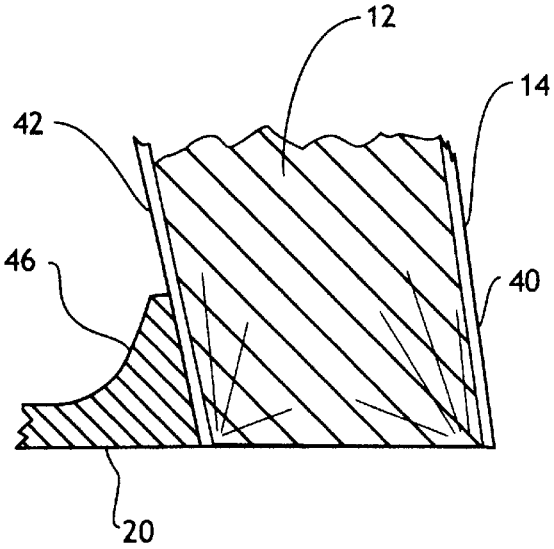

In FIGS. 3A and 3B, a reinforcing layer 40 is shown bonded to the strike surface 14 of the face wall 12, and a second reinforcing layer 42 is bonded to the rear or inner surface of the face wall 12. Epoxy or other strong adhesives can be used for bonding the layers 40 and 42 of material onto the face wall 12. The layers such as that shown at 40 and 42 can be metal, fiberglass resin composite materials, or a graphite fiber and resin composite. In one embodiment, a woven fiberglass layer about 0.015 inches thick impregnated with epoxy resin has formed a satisfactory reinforcing layer.

If desired, the reinforcing layer 40 can be formed around the edges of the face wall 12 as indicated by dotted lines 44.

In FIG. 3A, the shell 16 is shown with a built-up ledge or stop 46 which runs all or most of the way around the inner surface of the shell. Face wall 12 is supported by ledge 46 for increasing the strength of the joint between most or all of the perimeter of the face wall 12 and the inner surface of the shell 16.

In FIG. 3B, a variation is shown in which ledge 46 extends all the way around the front edge of the inner surface of the shell and face wall 12 is bonded to ledge 46. This construction is different from that of FIG. 3A since, in FIG. 3A, the shell 20 extends all around the perimeter of the face wall 12 as shown at 20A and in FIG. 3B, the portion 20A around the perimeter of face wall 12 is absent.

Prototypes of the club head were constructed similar to FIG. 3A, using metal shells with and without ledge 46. Strength was tested by projecting golf balls at the face to simulate actual hits by a golfer. Without the ledge, the structural strength of the face wall shell junction was marginal for strong hitters. With the ledge, strength was adequate for even the strongest hits known, having head speed between 140 and 150 miles per hour. Tests up to 170 mph head speed were conducted without failure. Ledge 46 is desirable, but better bonding at the shell face wall junction may eliminate the need for ledge 46.

A club shaft 48 is inserted in the hosel 28, and is cemented in place with an epoxy, as is common in club construction. The hosel or tube 28 can be cemented into the face wall attachment section 26 of the wall.

Grooves can be formed on the ball strike surface 14 of the face wall 12 if desired. For drivers such grooves are a matter of personal preference and have no substantial effect on their performance. Grooves slightly weaken the face.

Figure 4:
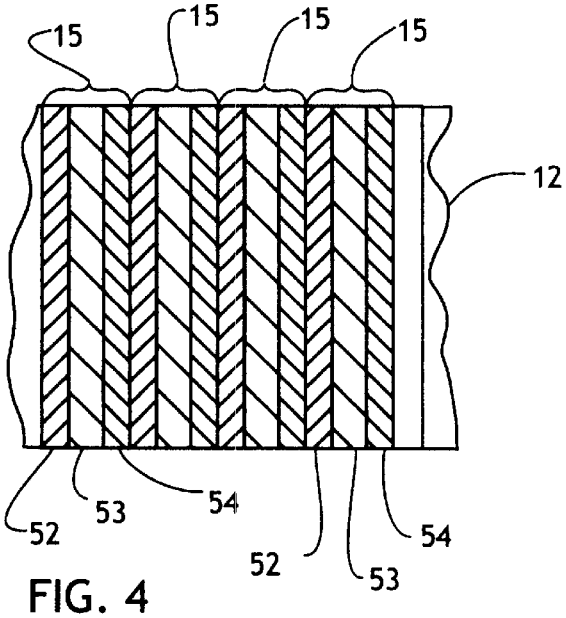
FIG. 4 is a front view of the face wall to illustrate the laminations that are used and the orientation of the wood grain in plies forming the laminations.

In FIG. 4, a sectional view of the face wall shows the maple laminations used. Each of the individual laminations of the face wall, which are shown at 15 in FIG. 1 is preferably about 3/16 of an inch thick and is made up of three plies. Each ply is made preferably about 1/16 of an inch thick. The strength of maple under load from a particular direction is dependent on the orientation of the grain of the wood. The individual laminations 15 extend generally uprightly or vertically as shown in FIG. 1. Each of the individual laminations 15 is made up of three plies as shown in FIG. 4. These plies include a first ply 52 that has its grain running uprightly, or generally parallel to the up and down direction, as shown in FIG. 1. This is approximately vertical when the club is held with the long axis of the face in a horizontal position. A second ply 53 is oriented in the same manner, and is bonded to the first ply 52, and a third ply 54 is made with the end grain shown in FIG. 4, that is, with the grain substantially perpendicular to the face surface 14. The sequence of three plies is repeated for each of the laminations 15 across the entire face wall. The strength that is noted subsequently, is based on measurements of yield strength of actual samples of laminated maple made of plies with the wood grain oriented in this manner. It is common practice to alternate sets of three plies in this way, but sometimes the number of plies may be two, or sometimes four or more.

Simple structural analysis supports the present design. Bending is the principal stress in the face wall due to the rearward force applied when there is impact with a ball. Other parts of the club head may have other important stresses. For example, the shell 16 may be primarily susceptible to failure in compression and/or in buckling. The maximum stress in corners and other parts of the club head may be much more complex, but are easily accommodated with a thin-wall shell. The face wall strength and weight is of primary concern when a large face surface is provided. The following discussion relates to bending stress in the face wall.

Figure 5:
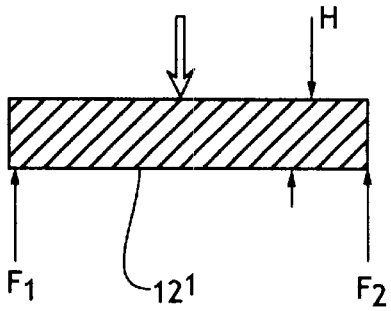
FIG. 5 is a schematic representation illustrating loading of a beam, representing a structural model of the load applied to the club face wall at the instant of impact with a ball.

Bending stress may be estimated approximately by the simplified structural model of FIG. 5. The load F on the face wall 12 caused by ball impact is supported by the shell 16 as F1 and F2 if inertia forces in the face wall 12' are disregarded.

The face wall 12' is shown in cross section. Its thickness (front to rear) is H. Force F causes a bending moment in the face wall, represented as a beam. The face wall 12' is not technically a straight beam supported at each end, but is supported all around its edge and is slightly curved. Even so, the model gives reasonable guidance for comparison of stresses caused by bending moments when the club face wall is made of various different materials and different kinds of construction, such as sandwich structures.

Beams of different materials can be compared. A practical case is when beams are compared which are made of homogeneous material having the same properties in all directions and at all points within the beam and also having the same width and length. Each beam in a comparison may be designed with the thickness required to support the needed bending moment which is the same for each beam. In this case the following equation can readily be derived by those experienced in structural analysis. W1 and W2 represent the weight per unit area for beams 1 and 2. Similarly, D1 and D2 represent the two densities, Sy1 and Sy2 represent the yield stresses for the two materials. In the equation, the actual values of the bending moment and the beam thickness cancel out.

$$W1/W2=(D1/D2)/\sqrt{(Sy1/Sy2)}$$

Table 1 gives a comparison among several materials which might be considered for the face wall. In this table, the value for face wall thickness H was arbitrarily chosen as 0.260 for 356 cast aluminum alloy. This is only for purposes of comparison among the materials and is representative of face wall thickness for this alloy for modern, large face drivers. The thickness for each of the other materials is calculated to give the same bending strength as the 356 aluminum. D is in pounds per cubic foot and Sy is the yield stress to be used in pounds per square inch. Each of the metals listed is assumed to be in the form of a casting except materials listed on the last two lines, which are forged. All the metals are assumed to be heat treated to maximum strength. The right hand column gives the ratio of W for each material to that of 356 cast aluminum alloy, as a reference.

TABLE 1

| Material | density D, pcf | strength Sy, psi | thick-ness, in | W W356 |
|---|---|---|---|---|
| laminated maple | 49.4 | 13,335 | .370 | .419 |
| ABS plastic | 67.8 | 7,000 | .510 | .794 |
| 356 cast aluminum | 167.6 | 27,000 | .260 | 1.000 |
| 17-4ph st. steel | 484.0 | 140,000 | .114 | 1.268 |
| titanium 6Al-4V | 273.0 | 128,000 | .119 | .748 |
| magnesium ZK60A | 114.0 | 30,000 | .247 | .645 |
| 7075 aluminum | 174.5 | 73,000 | .158 | .633 |

Table 1 shows that in this comparison, a laminated maple beam has much less weight for supporting the same bending moment as compared to all the other materials, being only 41.9% as heavy as 356 aluminum. The second best material in this table is 7075 aluminum and it is necessary for it to be 63.3% as heavy as 356 aluminum, which makes it 51% heavier than the laminated maple.

The strength of laminated wood is dependent on the orientation of the wood grain as previously mentioned. Also, laminated wood face walls could be made with three plies alternating in direction as described earlier for laminated maple, or similarly with two or four or more plies.

Other materials and structural arrangements which provide these advantages include certain other kinds of wood, laminated or not but being a hard wood such as maple or persimmon; fiber reinforced plastics (composites) , such as fiberglass with epoxy or polyester resins; similar constructions using graphite fiber or Kevlar® or other fiber; and honeycomb or sandwich construction with strong surface layers and light weight cores. Densities in the range of 35 to 100 pounds per cubic foot are preferred. Wood generally ranges from 35 to 65 pounds per cubic foot, while laminates may be higher. Magnesium, the least dense metal, has a density of 114 PCF.

With composite beams and honeycomb structures which are short (that is, the length is less than about 10 or 20 times the thickness) , internal shear stress usually causes failure and the potentially great bending strength fails to be realized, often by a large margin. Preliminary analysis indicated that with careful design, some such structures are lighter than solid metal face walls but heavier than laminated maple.

For any kind of face wall construction, compression strength must be greater than about 3,000 to 5,000 psi. All of the materials of Table 1 meet this requirement. Sandwich or honeycomb designs must meet this requirement, which may be difficult for them.

An important feature of the present design is that the face can be made with a large face area (hitting surface) with adequate strength, but without excessive weight for the face wall. The large face area is very important to reduce hits which are partly off the face.

Figure 8B:
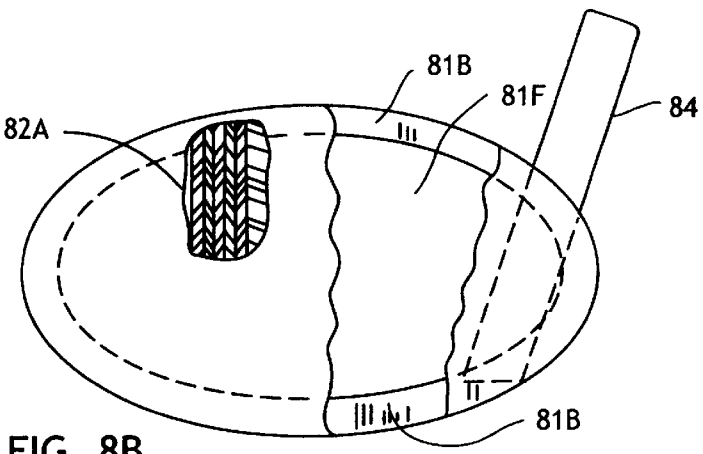
FIG. 8B is a front view of the driver head of FIG. 8A.
Figure 9:
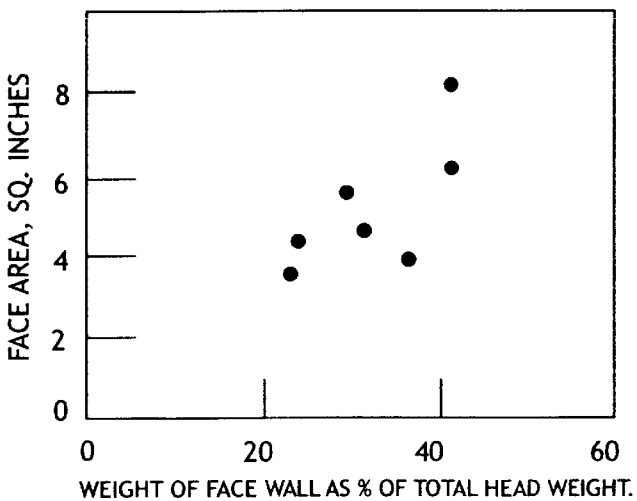
FIG. 9 is a graphical representation illustrating the relationship of progressively larger faces to the progressively higher percentage of total club head weight required for the face.
Figure 8A:
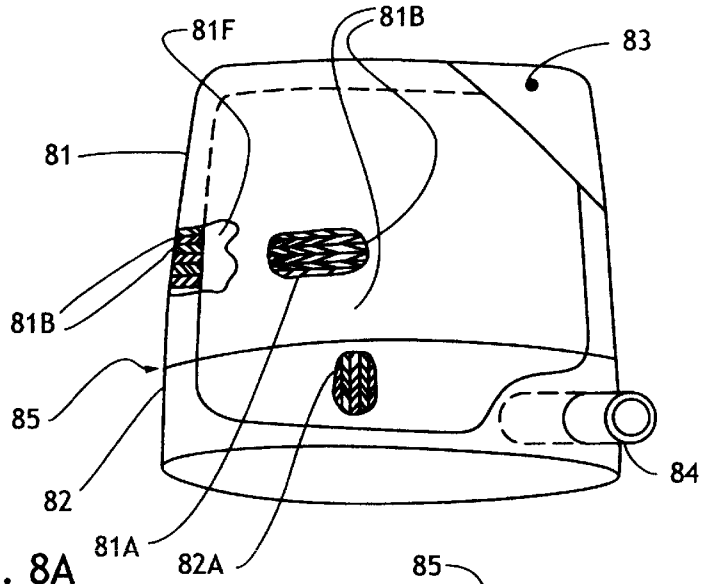
FIG. 8A is a top view of an alternate driver head construction.
Figure 8C:
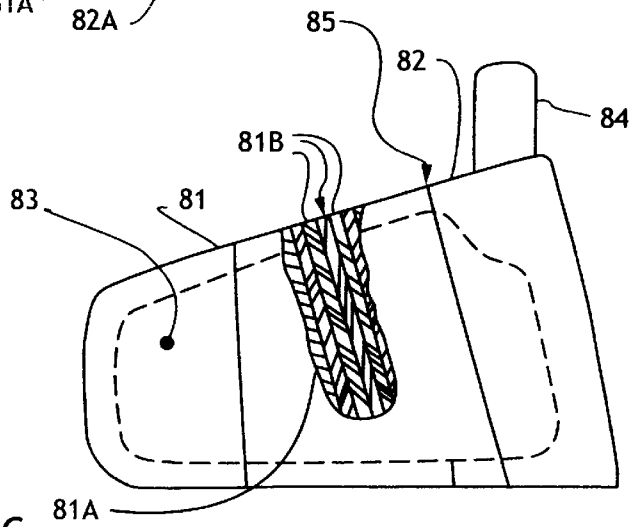
FIG. 8C is a view looking toward the toe end of the driver head of FIG. 8A.

FIGS. 8A, 8B and 8C show a preferred embodiment of the driver. The construction differs from the other embodiments mainly in that the rear shell portion is of laminated material, such as laminated maple.

In these figures, a rear shell 81 is fixed to a laminated face structure 82. The face structure 82 is made of laminations having plies parallel to the swing direction or perpendicular to the face, as shown in previous embodiments. A rear weight (or more properly mass), which is typically made of metal, is attached to the rear shell by a clamp, screw, bolt or by bonding it in place such as by means of epoxy cement. A tubular neck 84 or socket or hosel into which the club shaft (not shown) may be cemented is fixed to the face structure. Typically, neck 84 is made of metal. It is joined to the rest of the club head such as by use of epoxy cement. Face structure 82 is joined to rear shell 81, typically by use of epoxy cement at the joint indicated by numeral 85.

The interior of the club head is hollow as indicated by the dotted lines in FIGS. 8A, 8B and 8C. The hollow interior is formed by using elliptical ring shaped plies 81B, as shown in the break away portions in FIGS. 8A, 8B and 8C. The hollow interior defines a chamber 81F that could be filled with light weight foam or the like if desired. The interior chamber has a volume of at least 30 percent of the exterior volume, including the face wall.

Numerals 82A are partial views of the surface detail which illustrate a desirable orientation of the individual ring like plies 81B which make up each of the laminations of the face, in a similar way to what was illustrated in FIG. 4. The plies which are dotted represent approximately end views of the grain of the ply. Those plies with lines represent views with the grain running approximately parallel to the paper. For the face 82, a desirable arrangement as shown at 82A is to have 3 plies making up each lamination as for FIG. 4, but it is possible that more or fewer could be used in each lamination such as to provide good strength of the face to resist the typical impact loads.

Numerals 81A are partial views of the surface detail which illustrate a desirable orientation of the individual plies which make up each of the laminations for rear shell 81. In this case, 2 plies per lamination are suitable, but more could be used. This orientation strongly resists any tendency for the rear shell 81 to split along lines approximately perpendicular to the face. Other orientations may be suitable. The laminations, made up of two or more plies as shown have a thickness of about 3/16 of an inch. The individual plies are between 1/32 and 1/8 of an inch thick.

Weight 83 is far from the center of gravity and therefore contributes significantly to increase the moment of inertia for the club head about the center of gravity. Further, weight 83 may be mounted in various locations of shell 81 so as to provide a desirable means for a design change of the location of the center of gravity for best performance of the club. For typical values of the weight of weight 83, the right rear corner of the club head has been found to be a desirable location.

Laminations could be made of fiber reinforced plastic such as layers of epoxy impregnated fiberglass or graphite fiber in place of the laminated maple. It is reasonably easy and practical to cut laminated wood shapes such as required here with the desired directions of the fibers in the individual plies which make up each lamination. This is much more difficult with fiberglass and graphite fibers. Woods other than maple may be used, but maple is preferred.

Prior art drivers made of wood were solid wood except for minor material removal such as a 1 inch hole near the center for a weight. In this structure of FIGS. 8A–8C the internal volume of the chamber 81F is at least 30% of the exterior volume.

The importance of a large face was indicated above. One of its benefits is to reduce the probability of hits being partly off the face. These hits are called "POF" hits for "partly off the face" in this specification. This is of such great importance to golfers that it deserves further explanation.

Figure 6:
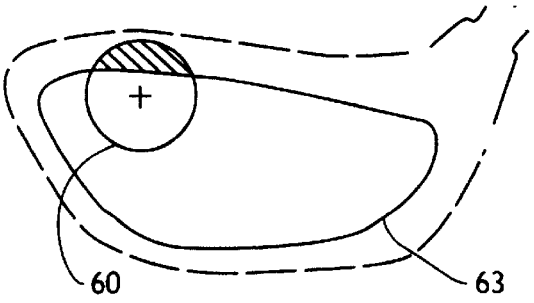
FIG. 6 is a schematic illustration of a club face showing a ball hit region to clarify the definition of hits which are partly off the face.

FIG. 6 shows a definition of POF hits for the specification. Numeral 60 represents an imprint of the ball against the face. Numeral 63 is the perimeter of the actual hitting area of the face. When more than 25% of a ball impacting that area would otherwise be a normal hit is found to be outside the perimeter of the hitting face, it is considered herein to be a POF hit.

FIG. 7 shows how face size, face shape, and face orientation affect the percentage of POF hits. In FIGS. 7A–7D, numerals 64–67 represent the face outlines and numeral 61 represents an imprint 0.95 inches in diameter, typical of a golfer with average head speed. Strong hitters have somewhat larger imprints.

Such imprints scatter in a statistically "normal" distribution over the club face. This has been studied statistically by the present inventors on many golfers of various handicap levels to find the orientation of a pattern of many such hits and the length and width of the distribution as measured statistically by the standard deviation in the long and the short axes of the distribution. The result is shown at 62 for 100 hits where the distribution was computer-generated to have the length and width distributions representative of a golfer of handicap 25. A computer was programmed to calculate the percentage of hits which would be POF hits for any given club face outline which was defined in the computer program, after thousands of hits. This allowed comparison of POF hits among various club faces. One hundred hits used for illustrations in FIGS. 7A–7D is an insufficient number for calculating POF percentages.

Figure 7A:
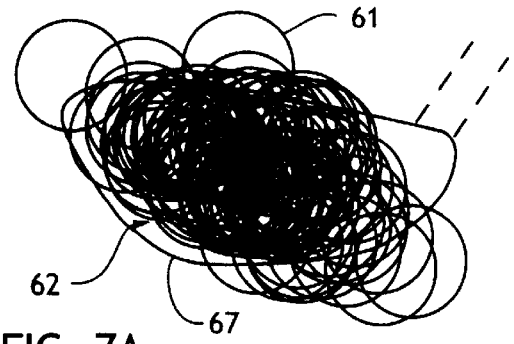
FIGS. 7A–7D show how club face size and orientation affect the percentage of hits which are partly off the face for a 25 handicap golfer.
Figure 7B:
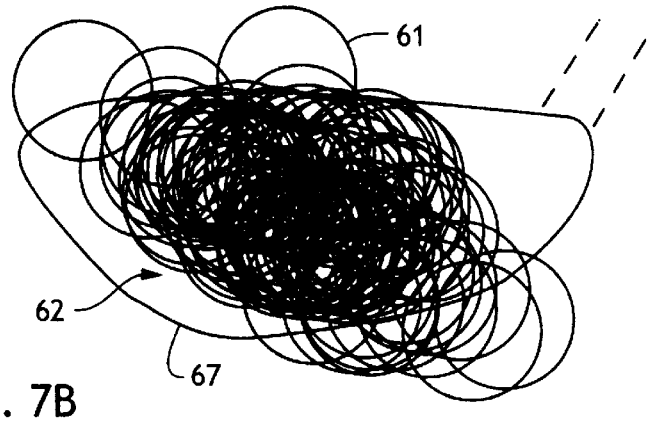
Figure 7C:
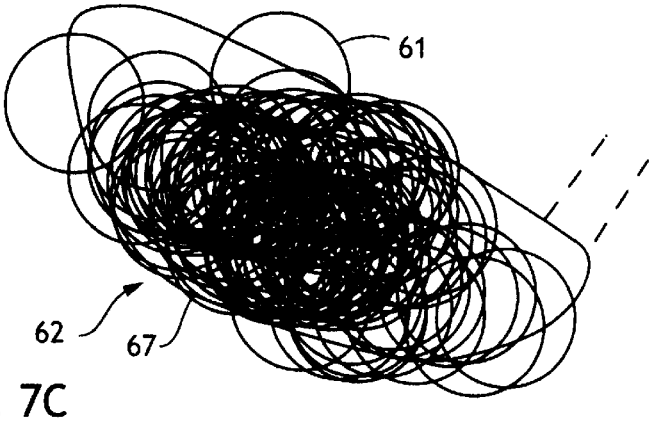
Figure 7D:
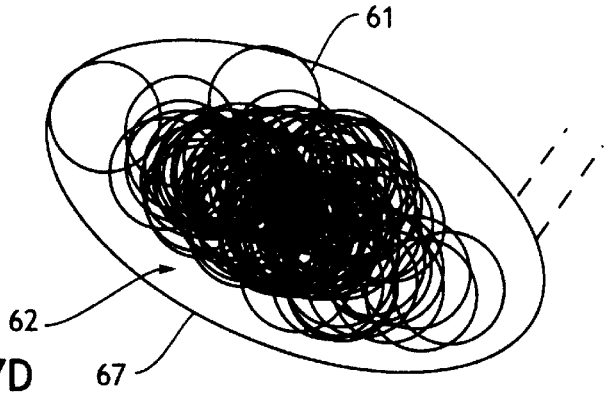

In FIG. 7A, a typical club face having an area of 3.8 square inches with 15.7% POF hits is shown. FIG. 7B shows a larger face of 4.7 square inches area with 5.5% POF hits. FIG. 7C shows this same larger face but better oriented to match the hit pattern and has 2.8% POF hits. FIG. 7D shows a face having only 0.2% POF hits due to a still larger face with area of 8.1 square inches, an optimum elliptical face outline shape, and optimum face orientation to match the hit pattern, similarly to FIG. 7C.

The surface area, the face width, and the POF hit percentages for 7 actual drivers was measured for comparison. Face width, means the narrowest dimension of the club face when viewed in a direction which is perpendicular to the face at the face center. When face width is large, it is much more difficult to design the club face to have adequate strength for the large loads of impact without encountering excessive face weight. Low POF % indicates the advantage for golfers. Hits which are partly off the face are usually the very worst hits a golfer can make with a driver. Accordingly, low POF % is highly desirable and is lowest when the club face has a large area, optimum face shape, and good orientation. Optimum orientation of the face was discussed in issued U.S. Pat. No. 5,366,223. U.S. Pat. No. 5,366,223 explains more about the ability to calculate POF %, using experimental data on golfers which shows how hits on a club face scatter in a statistically random distribution. Computer algorithms for calculating POF % were used.

The results are given in Table 2. Drivers identified in Table 2 as ELB and BAM are experimental (not public) models made in accordance with this specification, which have properly oriented, elliptically shaped, large faces which approximate the shape of the elliptical distribution of golfers hits. The remarkable advantage of low POF % is clearly evident. Table 2 shows driver 47 which was representative of driver faces popular about 1990 and earlier. Driver "US patent" refers to the face outline of FIG. 2B of U.S. Pat. No. 5,366,223, having significantly larger area but rather poor shape orientation. Drivers BBB, BXD, and GLJ are modern designs and had still larger faces, but their face shapes and orientations were not as taught in this specification, which accounts for their higher POF % values as compared to ELB and BAM, the clubs embodying the present invention.

TABLE 2

POF %, Face Area, and Face Width For 7 Representative Drivers 47 refers to Golfsmith model 47 driver; "US patent" refers to the face shown in FIG 2B of U.S. Pat. No. 5,366,223; BBB refers to the Biggest Big Bertha (a trademark of Callaway Golf Company). BXD refers to a driver made by J. Osawa & Company (Tokyo). GLJ refers to the Golfsmith "Long Jon" driver. ELB and BAM are experimental (not public) drivers made according to the present invention. HCP means handicap.

| CLUB IDENTITY | FACE WIDTH, INCHES | AREA, SQUARE INCHES | POF % HCP 0 | HCP 10 | HCP 20 | HCP 30 |
|---|---|---|---|---|---|---|
| 47 | 1.45 | 3.51 | .59 | 5.05 | 12.5 | 14.3 |
| US PATENT | 1.53 | 4.50 | .27 | 3.35 | 8.3 | 12.7 |
| BBB | 1.70 | 4.49 | .19 | 2.35 | 6.3 | 10.5 |
| BXD | 1.60 | 4.60 | .23 | 2.32 | 5.37 | 8.1 |
| GLJ | 1.75 | 5.21 | .04 | 1.38 | 4.58 | 6.1 |
| ELB | 1.90 | 5.76 | .00 | .08 | .52 | 1.56 |
| BAM | 2.40 | 8.10 | .00 | .05 | .35 | .80 |

Thus, the largest existing face known in the prior art is about 5.21 $in^2$. A face area of an experimental driver of 5.76 $in.^2$ significantly reduces POF hits. A face of 6.3 $in.^2$ or greater provides improvement. When the face exceeds 7 $in.^2$ in area, the location of the weight in the face area being between 40% to 50% of the total weight becomes especially important.

POF hits are probably the worst errors made by golfers. They are common with average golfers but even tour professionals sometimes have them. The optimum face to suppress this problem, as described in connection with FIGS. 7A–7D, requires a large, strong face such as is best provided by the present invention.

The air drag due to a larger face has also been studied, both experimentally and by use of aerodynamic theory. It has been found that even the very large face causes loss of distance of no more than 1 or 2 yards.

Although the present invention has been described with reference to preferred embodiments, workers skilled in the art will recognize that changes may be made in form and detail without departing from the spirit and scope of the invention.

What is claimed is:

1. A golf club head construction including a face wall made of wood lamination sections having a wood grain and defining a periphery, said face wall being shaped for providing a ball strike face having a heel, a toe, and a long axis extending between the heel and toe, a shell defining a club head having a selected wall thickness to provide light weight, said shell having a periphery that conforms to the periphery of said face wall, and a bonding material securing the face wall to the shell around the periphery of the face wall, said face wall having a face area exceeding 5.3 square inches, and wherein said lamination sections are perpendicular to said long axis and are made up of at least three separate plies of wood, having grain parallel to the plies, at least two first plies secured to each other and having a wood grain extending generally parallel to an up-down direction of the club face section and an additional ply adhered to one of the first plies and having a wood grain which is generally horizontal.

2. The golf club head of claim 1, wherein the face wall thickness relative to the thickness of the shell is at least 5 times that of the shell.

3. The golf club head of claim 1, wherein each lamination section is composed of two or more plies and said plies extend generally transverse to a long axis of the face wall.

4. The golf club head of claim 3 wherein the face wall has one structure selected from a group consisting of a solid wood structure, a laminated wood structure, a fiber-reinforced plastic structure, a composite plastic structure reinforced with graphite fibers, a composite plastic structure reinforced with Kevlar® fiber, a sandwich structure, and a honeycomb structure.

5. The golf club head of claim 4 wherein the face area exceeds 6.3 square inches.

6. The golf club head of claim 5 wherein the shell is selected from a group consisting of alloys of aluminum, alloys of stainless steel, alloys of titanium, fiber reinforced plastics, and wood.

7. The golf club head of claim 5 wherein the shell is formed to be generally rectilinear in plan view with a rear edge extending generally parallel to the face wall.

8. The golf club head of claim 1, wherein the shell is hollow and wherein the laminated face extends inwardly from the face with a thickness less than 50% of the length of the shell in a direction from the face to a trailing end of the shell, the rest of the shell being composed of plies of wood.

9. The golf club head of claim 8, wherein the shell is made of plies of wood formed as hollow rings.

10. The golf club head of claim 1 and a reinforcing layer applied to the face wall on a ball striking side thereof for reinforcing the face wall.

11. The golf club head of claim 10, and a second reinforcing layer bonded to the face wall on an opposite side thereof from the reinforcing layer on the ball striking side thereof.

12. A golf club head construction including a face wall defining a periphery, said face wall being shaped for providing a ball strike face, a shell defining a club head having a selected wall thickness to provide light weight, the shell being made of wood plies shaped as rings to form an interior chamber having a volume of at least 30% of the volume of the golf club head including the face wall, said shell having a periphery that conforms to the periphery of said face wall, and a bonding material securing the face wall to the shell around the periphery of the face wall, said face wall having a face area exceeding 6 square inches and having between 40% and 50% of the total head weight.

13. The golf club head of claim 12, wherein the face wall and shell are made of a material having the density and strength characteristics of a beam of laminated maple wood.

14. A golf club head construction including a face wall defining a periphery, said face wall being shaped for providing a ball strike face, a shell defining a club head having a selected wall thickness to provide light weight, said shell having a periphery that conforms to the periphery of said face wall, and a bonding material securing the face wall to the shell around the periphery of the face wall, said face wall having a face area exceeding 5.3 square inches, the weight of the face wall being between 40% and 50% of the total head weight, and wherein the face wall is made of a material having a density of between 35 and 100 pounds per cubic foot.

15. The golf club head of claim 14 and a weight mounted on the interior of the shell at an edge opposite from the face wall.

16. A golf club head construction, including a face wall defining a periphery, said face wall being shaped for providing a ball strike face, a hollow shell defining a club head having a selected wall thickness to provide light weight, said shell having a periphery that encircles the periphery of said face wall, and a bonding material securing the face wall to the shell around the periphery of the face wall, wherein the face wall is made to be at least five times the thickness of the shell wall, the face wall having a large face for striking a ball, and being made of wood having a density in the range of 50 pounds per cubic foot, and wherein the shell behind the face wall is composed of laminations of maple having portions with wood grain parallel to a long axis of the ball strike face.

17. The golf club head of claim 16, wherein the face has an area greater than 5.3 square inches and is made of laminated maple wood and the shell is made of materials having the strength characteristics selected from a group consisting of strong metals including at least one of the group consisting of stainless steel, aluminum alloys, titanium alloys, the face wall having a weight less than 40% of the total weight of the golf club head.

* * * * *